US010297405B2

(12) United States Patent
Wang et al.

(10) Patent No.: US 10,297,405 B2
(45) Date of Patent: May 21, 2019

(54) KEYSWITCH AND KEYBOARD CAPABLE OF SHOWING MOVEMENT DEPTH

(71) Applicant: PixArt Imaging Inc., Hsin-Chu (TW)

(72) Inventors: Tsung-Fa Wang, Hsin-Chu (TW); Shih-Wei Kuo, Hsin-Chu (TW)

(73) Assignee: PixArt Imaging Inc., Hsin-Chu (TW)

( * ) Notice: Subject to any disclaimer, the term of this patent is extended or adjusted under 35 U.S.C. 154(b) by 98 days.

(21) Appl. No.: 15/491,990

(22) Filed: Apr. 20, 2017

(65) Prior Publication Data

US 2018/0137997 A1 May 17, 2018

(30) Foreign Application Priority Data

Nov. 15, 2016 (TW) ..... 105137167 A

(51) Int. Cl.

| | |
|---|---|
| ***H01H 9/26*** | (2006.01) |
| ***H01H 13/72*** | (2006.01) |
| ***H01H 13/76*** | (2006.01) |
| ***H01H 13/85*** | (2006.01) |
| ***H01H 3/12*** | (2006.01) |

(52) U.S. Cl.
CPC ..... *H01H 13/85* (2013.01); *H01H 3/125* (2013.01); *H01H 2215/028* (2013.01)

(58) Field of Classification Search
CPC ..... H01H 9/20; H01H 2003/00; H01H 9/02; H01H 9/12; H01H 2009/20; H01H 2013/00; H01H 2215/00; H01H 2215/006; H01H 2215/016; H01H 2215/018; H01H 2215/028; H01H 3/00; H01H 3/02; H01H 3/12; H01H 3/32; H01H 3/125; H01H 3/40; H01H 5/04; H01H 13/00; H01H 13/02; H01H 13/85; H01H 13/14; H01H 13/18; H01H 13/20; H01H 13/26; H01H 13/28; H01H 13/50; H01H 13/70
USPC ..... 200/5 A
See application file for complete search history.

(56) References Cited

U.S. PATENT DOCUMENTS 4,475,142 A * 10/1984 Sparks ..... H03K 17/975 361/288

* cited by examiner

*Primary Examiner* — Anthony R Jimenez
(74) *Attorney, Agent, or Firm* — Winston Hsu

(57) ABSTRACT

A keyboard has a keyswitch capable of showing its movement depth. The keyswitch includes a substrate, a lifting unit, a multistage positioning component and a keycap. The lifting unit is disposed on the substrate. The multistage positioning component is disposed on the substrate and has a plurality of first actuating portions. The keycap is connected with the lifting unit and adjacent by the multistage positioning component. The keycap has a second actuating portion. The keycap is moved relative to the substrate via the lifting unit, and the second actuating portion can contact against one of the plurality of first actuating portions to generate a feedback signal.

20 Claims, 7 Drawing Sheets

KEYSWITCH AND KEYBOARD CAPABLE OF SHOWING MOVEMENT DEPTH

BACKGROUND OF THE INVENTION

1. Field of the Invention

The present invention relates to a keyswitch and a keyboard, and more particularly, to a keyswitch and a keyboard capable of showing its movement depth.

2. Description of the Prior Art

Please refer to FIG. 7. FIG. 7 is a structural diagram of a mechanical keyswitch 70 in prior art. A keycap 72 and a related lower stretching portion of the conventional mechanical keyswitch 70 are movably disposed inside a supporter 74, and the keycap 72 can be moved relative to the supporter 74 via a lifting unit 76. While the keycap 72 is pressed to move downwardly along the supporter 74, a first resilient component 78 is resiliently deformed to contact a second resilient component 80 for forming a conductive channel and outputting an actuating signal, and the actuating signal is analyzed to acquire a control command about the pressed mechanical keyswitch 70. However, the conventional mechanical keyswitch 70 utilizes the lifting unit designed as a compression spring to provide the resilient recovering force, the user merely feel one-stage hand feeling within an operational stroke of the conventional mechanical keyswitch, and design of a keyswitch having multistage controlling function is an important issue in the related mechanical design industry.

SUMMARY OF THE INVENTION

The present invention provides a keyswitch and a keyboard capable of showing its movement depth for solving above drawbacks.

According to the claimed invention, a keyswitch capable of showing a movement depth is disclosed. The keyswitch includes a substrate, a lifting unit, a multistage positioning component and a keycap. The lifting unit is disposed on the substrate. The multistage positioning component is disposed on the substrate, and the multistage positioning component has a plurality of first actuating portions. The keycap is connected with the lifting unit and disposed adjacent by the multistage positioning component. The keycap has a second actuating portion. The keycap is moved relative to the substrate via the lifting unit and the second actuating portion contacts against one of the plurality of first actuating portions to generate a feedback signal accordingly.

According to the claimed invention, the keyswitch further includes a processing unit disposed on the substrate. The processing unit analyzes a moving distance of the keycap relative to the substrate or analyzes contact relation between the second actuating portion and one of the plurality of first actuating portions to acquire input information while the keyswitch is pressed.

According to the claimed invention, the multistage positioning component is an elastic piece, the plurality of first actuating portions respectively are curved structures, and the curved structures are arranged on a body of the multistage positioning component at a moving direction of the keycap. A fixing end of the multistage positioning component is connected to the substrate, and a free end of the multistage positioning component points toward the keycap suspended above the substrate by the lifting unit. Or, two opposite ends of the multistage positioning component are respectively disposed on an inner wall of a supporting component, and the supporting component is located between the substrate and the keycap. At least one of the plurality of first actuating portions and the second actuating portion is made of resilient material.

According to the claimed invention, the keyswitch further includes an optical detecting unit disposed on the substrate and electrically connected to the processing unit, and the optical detecting unit is adapted to detect a movement of the keycap relative to the substrate. A supporting component is disposed on the substrate, and the keycap is partly disposed inside the supporting component in a movable manner.

According to the claimed invention, the multistage positioning component is an electrode module, the plurality of first actuating portions respectively are electrode terminals, the electrode terminals are arranged on an inner wall of a supporting component at a moving direction of the keycap, and the supporting component is located between the substrate and the keycap. The second actuating portion is made of conductive material, the processing unit is electrically connected to the electrode terminals, the processing unit analyzes the feedback signal generated by contact between the second actuating portion and one of the electrode terminals to acquire the input information while the keyswitch is pressed.

According to the claimed invention, a keyboard capable of showing a movement depth is disclosed. The keyboard includes a substrate and a plurality of keyswitches. The plurality of keyswitches is disposed on the substrate. Each keyswitch includes a lifting unit, a multistage positioning component and a keycap. The lifting unit is disposed on the substrate. The multistage positioning component is disposed on the substrate, and the multistage positioning component has a plurality of first actuating portions. The keycap is connected with the lifting unit and disposed adjacent by the multistage positioning component. The keycap has a second actuating portion. The keycap is moved relative to the substrate via the lifting unit and the second actuating portion contacts against one of the plurality of first actuating portions to generate a feedback signal accordingly.

The keyswitch and the related keyboard of the present invention utilize the multistage positioning component to be cooperated with the actuating portion of the keycap to provide the feedback function of showing the movement depth. The multistage positioning component can be the elastic piece structure having the free end for wavy motion, or the elastic piece structure having the two opposite ends fixed on the wall and the middle part capable of being twisted and deformed, or the electrode terminal utilizing conductive current to form the feedback signal. The multistage positioning component with an elastic piece form generates the feedback signal according to the rebounding force or the rebounding sound, so that the user or the processing unit can identify the movement depth of the keyswitch. The multistage positioning component can define the number of feedback stages by varying amounts of the first actuating portion and the electrode terminal. The keyswitch can generate the specific feedback signal while being moved across each feedback stage. The feedback signals respectively generated by the keyswitch moved across all feedback stages of the multistage positioning component can be utilized to purely provide the touch hand feeling; for example, the multistage positioning component may produce several feedback sound or supply powerful feedback force for helping the user to feel the movement depth by auditory sense and tactile sense while the keyswitch is deeply moved. Besides, the feedback signal generated from different feedback stages can be represented as assorted control commands in accordance with the movement depth; for example, the keyswitch can output the minuscule letter by slight press and further output the capital letter by heavy press.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
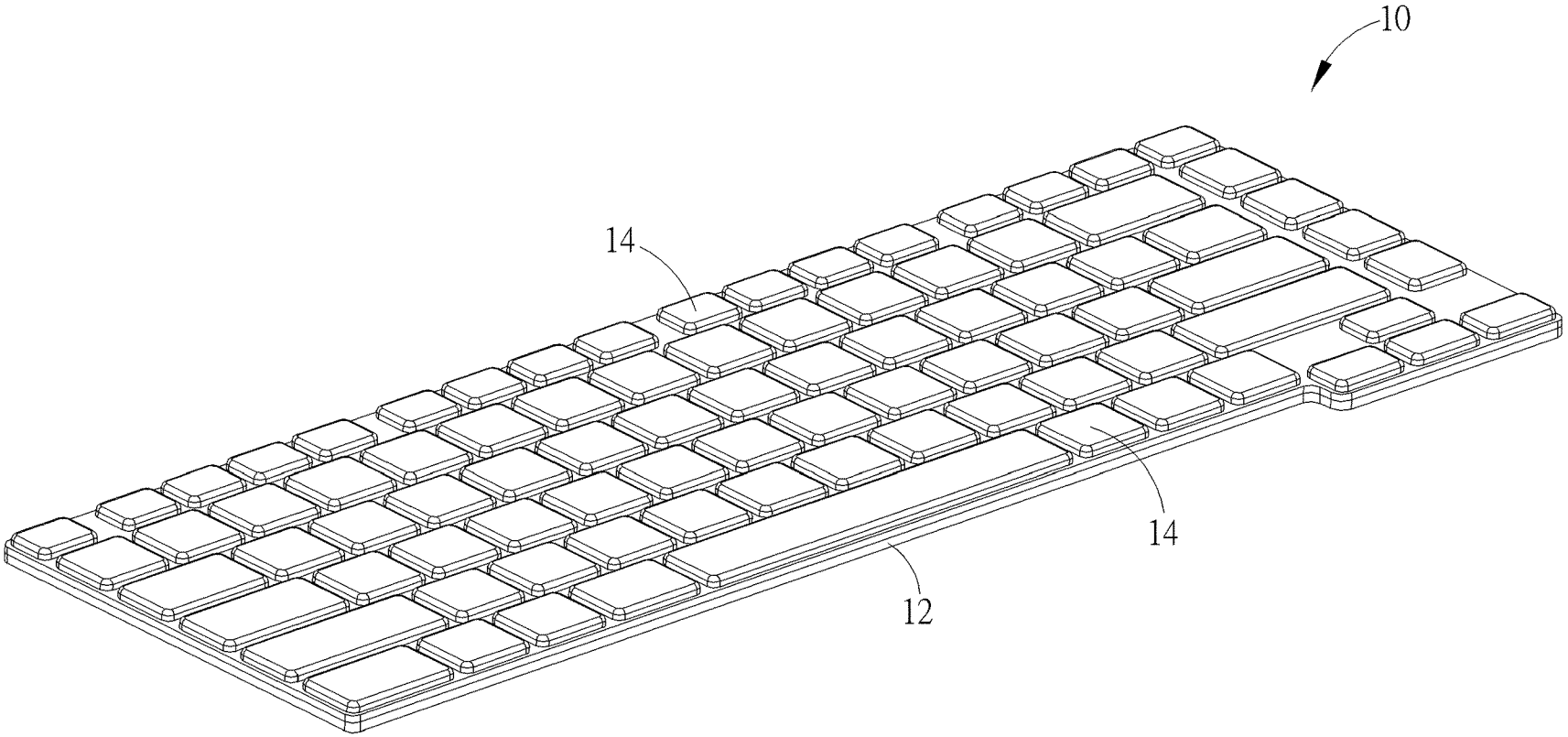
FIG. 1 is a structural diagram of a keyboard according to an embodiment of the present invention.
Figure 2:
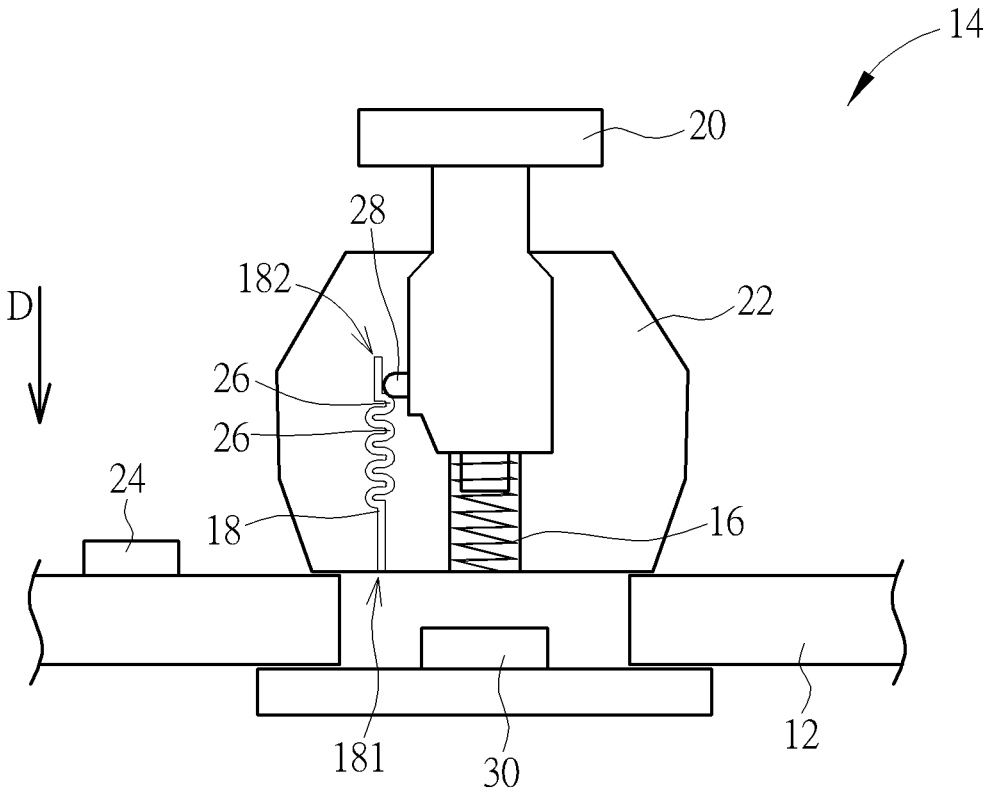
FIG. 2 and FIG. 3 respectively are structural diagrams of a keyswitch indifferent operation modes according to a first embodiment of the present invention.
Figure 3:
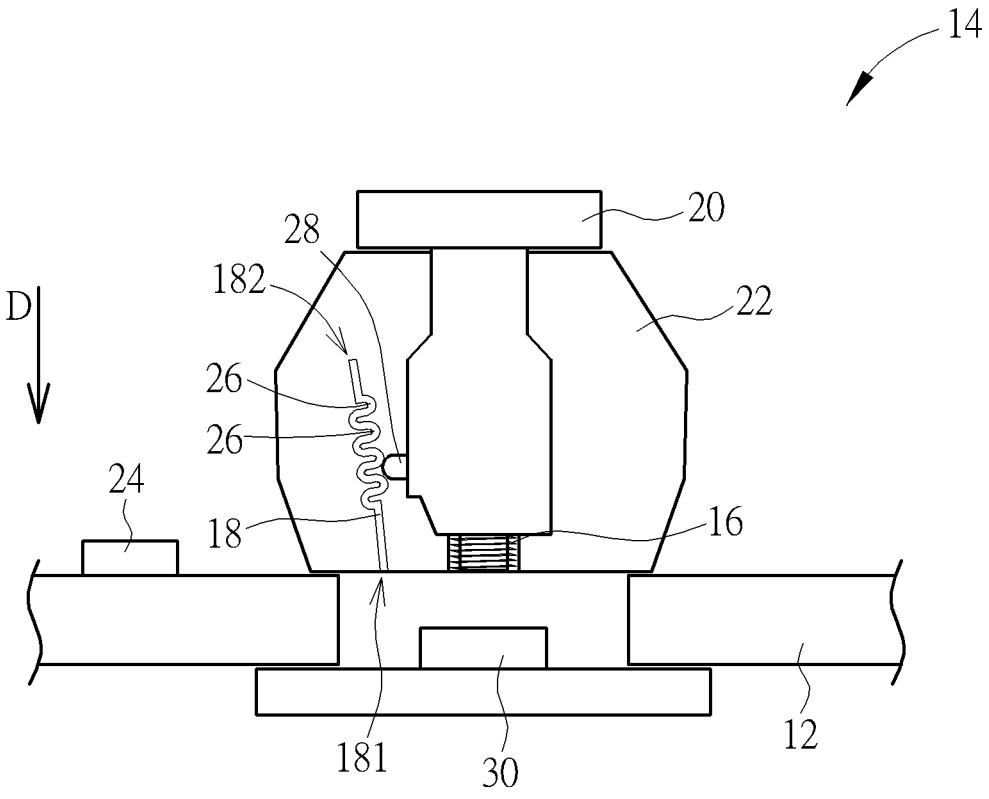

Please refer to FIG. 1 to FIG. 3. FIG. 1 is a structural diagram of a keyboard 10 according to an embodiment of the present invention. FIG. 2 and FIG. 3 respectively are structural diagrams of a keyswitch 14 in different operation modes according to a first embodiment of the present invention. The keyboard 10 includes a substrate 12 and a plurality of keyswitches 14, and the plurality of keyswitches 14 is arranged on the substrate 12 in sequence. At least one or more keyswitches 14 of the plurality of keyswitches 14 can include a lifting unit 16, a multistage positioning component 18, a keycap 20, a supporting component 22 and a processing unit 24. The lifting unit 16, the multistage positioning component 18, the supporting component and the processing unit 24 are respectively disposed on corresponding positions of the substrate 12. The multistage positioning component 18 preferably includes a plurality of first actuating portions 26. A lower portion of the keycap 20 is partly disposed inside the supporting component 22 in a movable manner. The keycap 20 is connected with the lifting unit 16 and disposed adjacent by the multistage positioning component 18. The keycap 20 includes a second actuating portion 28 to be cooperated with the plurality of first actuating portions 26.

In the first embodiment, the keyswitch 14 can include an optical detecting unit 30 disposed on the substrate 12 and electrically connected to the processing unit 24. While the keyswitch 14 is pressed, the keycap 20 is moved relative to the substrate 12 up and down via the lifting unit 16, the optical detecting unit 30 emits an optical detecting signal toward the lower portion of the keycap 20, the processing unit 24 receives and analyzes an optical reflecting signal from the keycap 20 to calculate a moving distance of the keycap 20 relative to the substrate 12. Since the keycap 20 is moved, the second actuating portion 28 alternately slides over the plurality of first actuating portions 26, and a feedback signal is generated accordingly while the second actuating portion 28 is stopped to abut against one of the plurality of first actuating portions 26. The said feedback signal can be utilized to identify a movement depth of the keyswitch 14. In addition, the processing unit 24 further can analyze contact relation between the second actuating portion 28 and the specific first actuating portion 26 in accordance with parameter variation of the feedback signal, to acquire input information or a control command while the keyswitch 14 is pressed.

Generally, the multistage positioning component 18 can be an elastic piece structure. A fixing end 181 of the multistage positioning component 18 is connected to the substrate 12, and a free end 182 of the multistage positioning component 18 points toward the keycap 20 suspended above the substrate 12. The plurality of first actuating portions 26 respectively are curved structures, the curved structures are sequentially arranged on a body of the elastic piece of the multistage positioning component 18 at a moving direction D of the keycap 20. Therefore, the feedback signal generated by contact or impact between the second actuating portion 28 and the first actuating portion 26 may be a sound signal (which is produced by friction) or a rebounding signal (which is produced by a resilient recovering force of the deformed elastic piece), and the user can feel multistage operational hand feeling of the keyswitch 14 in accordance with the feedback signal. An amount and curvatures of the curved structures are not limited to the above-mentioned embodiment, which depend on design demand.

As shown in FIG. 2, the keyswitch 14 is set in an initial mode, the keycap 20 is lifted to a high position by the lifting unit 16, and the multistage positioning component 18 is not deformed via pressure of the second actuating portion 28. As shown in FIG. 3, the keycap 20 is pressed, the keycap 20 is moved relative to the supporting component 22 downwardly, the lifting unit 16 is compressed to store the resilient recovering force, the second actuating portion 28 sequentially contacts against the plurality of first actuating portions 26, and the user can get wise to the movement depth of the keyswitch 14 by identifying the sound feedback signal (such as the number of clicks) generated by contact between the first actuating portion 26 and the second actuating portion 28. Further, the user may get wise to the movement depth of the keyswitch 14 in accordance with the rebounding feedback signal applied to the second actuating portion 28 by deformation of eth multistage positioning component 18; for example, the rebounding force is increased since the keyswitch is deeply pressed.

Figure 4:
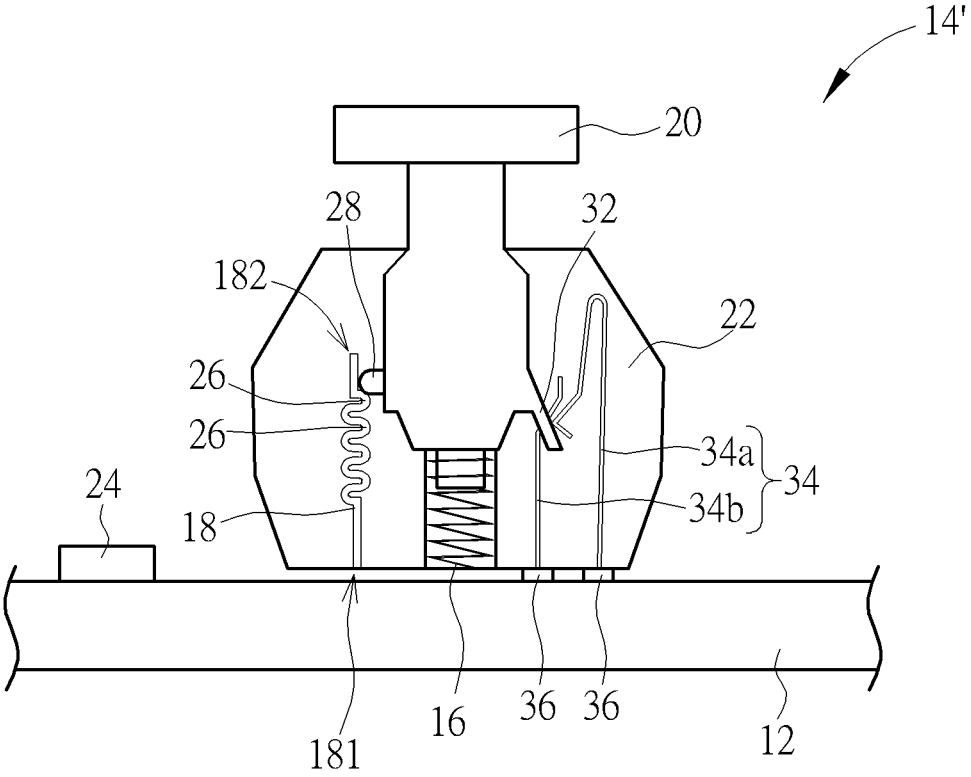
FIG. 4 is a structural diagram of the keyswitch according to a second embodiment of the present invention.

The optical keyswitch is an example of the above-mentioned embodiment, and actual application can be varied accordingly. The multistage positioning component of the keyswitch is further suitable for a mechanical keyswitch. Please refer to FIG. 4. FIG. 4 is a structural diagram of a keyswitch 14' according to a second embodiment of the present invention. The keyswitch 14' further includes an actuating portion 32 and a resilient conductive component 34, the actuating portion 32 is disposed under the lower portion of the keycap 20, and the resilient conductive component 34 is disposed inside the supporting component 22 and contacts against a conductive terminal 36 of the substrate 12. While the keycap 20 is not pressed, two parts **34*a* and 34*b* of the resilient conductive component 34 are separated. While the keycap 20 is pressed downwardly, the actuating portion 32 drives resilient deformation of the resilient conductive component 34 to contact the part 34*a* with the part 34*b*, and an actuating signal is output by the conductive terminal 36; meanwhile, the second actuating portion 28 gradually abuts against the plurality of first actuating portions 26 on the multistage positioning component 18, so as to generate the sound feedback signal or the rebounding feedback signal for determining the movement depth of the keyswitch 14'**.

Figure 5:
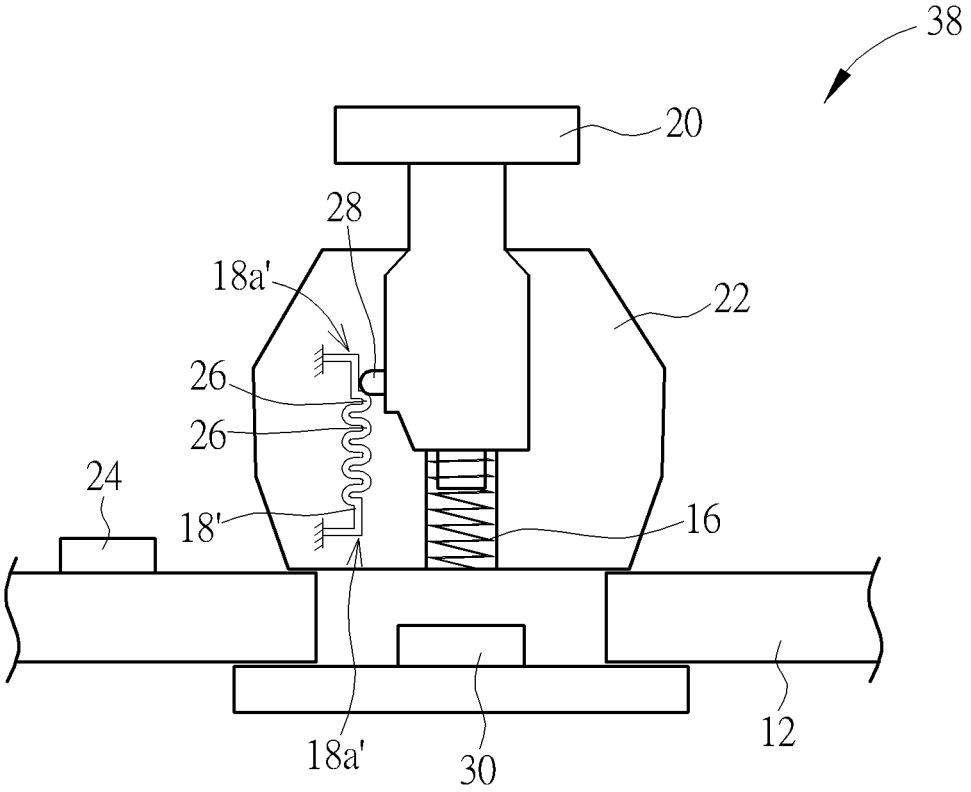
FIG. 5 is a structural diagram of the keyswitch according to a third embodiment of the present invention.

Please refer to FIG. 5. FIG. 5 is a structural diagram of the keyswitch 38 according to a third embodiment of the present invention. Two opposite ends of the multistage positioning component 18' of the keyswitch 38 are respectively disposed on an inner wall of the supporting component 22. The supporting component 22 can be a housing structure with any form, the two opposite ends 18*a*' of the multistage positioning component 18' are fixed on the inner wall of the housing structure, and a middle part (the part except the ends 18*a*', which means the part where on the plurality of first actuating portions 26 is disposed) of the multistage positioning component 18' does not contact against or is not adhered to the inner wall of the housing structure preferably. A tiny interval is formed between the inner wall and the plurality of first actuating portions 26 for being buffer space while the multistage positioning component 18' is resiliently deformed. When the keycap 20 is pressed, the second actuating portion 28 sequentially contacts against the plurality of first actuating portions 26, and the feedback signal is generated by friction and/or the resilient recovering force produced while the first actuating portion 26 is collided with the second actuating portion 28 for determining the movement depth of the keyswitch 38.

In the second embodiment and the third embodiment, elements having the same numeral as ones of the first embodiment have the same structures and functions, and a detailed description is omitted herein for simplicity. The keyswitch 38 in the third embodiment can be applied to the mechanical keyswitch illustrated in the second embodiment, arrangements and functions of the actuating portion and the resilient conductive component of the keyswitch 38 are similar to ones of the second embodiment. Besides, at least one of the first actuating portion 26 and the second actuating portion 28 in the first embodiment, the second embodiment and the third embodiment is made of resilient material, and the feedback signal can be generated by impact and friction between the two actuating portions; moreover, the present invention may utilize the first actuating portion 26 and the second actuating portion 28 made of the resilient material both. An amount and curvatures of the first actuating portion 26 are not limited to features shown in figures, and the arrangement and dimensions of the first actuating portions 26 can be defined according to the feedback recovering force and the number of feedback stages about the needed hand feeling for customization.

Figure 6:
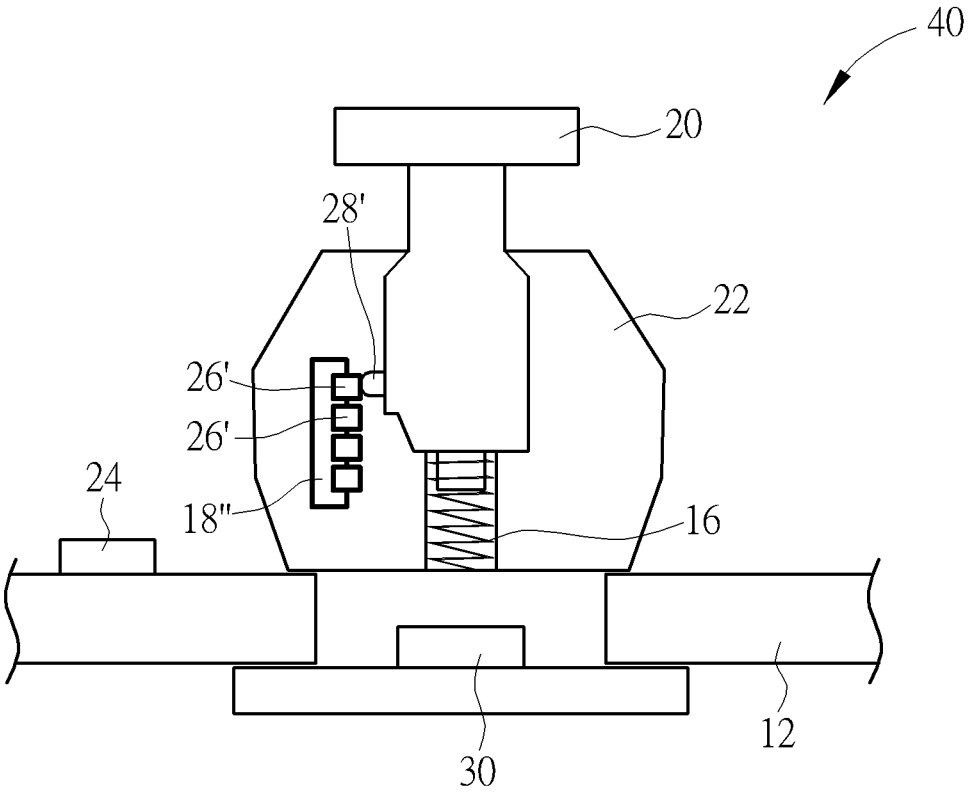
FIG. 6 is a structural diagram of the keyswitch according to a fourth embodiment of the present invention.
Figure 7:
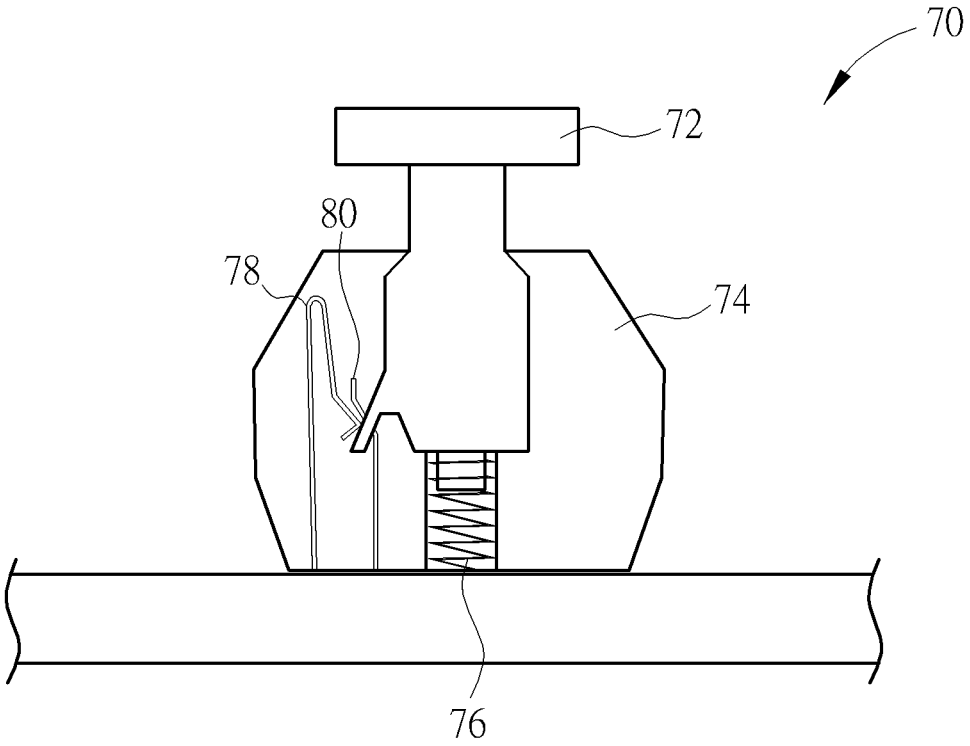
FIG. 7 PRIOR ART
FIG. 7 is a structural diagram of a mechanical keyswitch in prior art.

Please refer to FIG. 6. FIG. 6 is a structural diagram of the keyswitch 40 according to a fourth embodiment of the present invention. The multistage positioning component 18" of the keyswitch 40 can be an electrode module, the plurality of first actuating portions 26' are electrode terminals of the electrode module, and the electrode terminals are electrically connected to the processing unit 24 and arranged on the inner wall of the supporting component 22 at the moving direction D of the keycap 20. The first actuating portion 26' can be designed as a conductive spacer without resilience or a conductive elastic piece with resilient recovering function. The second actuating portion 28' of the keycap 20 is made of conductive material accordingly. With a downward distance variation of the pressed keycap 20, the second actuating portion 28' can alternately contact against one of the plurality of first actuating portions 26', the feedback signal is generated by conductive contact between the first actuating portion 26' and the second actuating portion 28', and the processing unit 24 can determine the movement depth and the output information of the pressed keyswitch 40 in accordance with parameter variation of the feedback signal. For example, the keyswitch 40 is determined as being slightly pressed to output a first control command while the second actuating portion 28' conductively contacts the highest first actuating portion 26', and the keyswitch 40 is determined as being heavy pressed to output a second control command while the second actuating portion 28' conductively contacts the lowest first actuating portion 26'.

In conclusion, the keyswitch and the related keyboard of the present invention utilize the multistage positioning component to be cooperated with the actuating portion of the keycap to provide the feedback function of showing the movement depth. The multistage positioning component can be the elastic piece structure having the free end for wavy motion, or the elastic piece structure having the two opposite ends fixed on the wall and the middle part capable of being twisted and deformed, or the electrode terminal utilizing conductive current to form the feedback signal. The multistage positioning component with an elastic piece form generates the feedback signal according to the rebounding force or the rebounding sound, so that the user or the processing unit can identify the movement depth of the keyswitch. The multistage positioning component can define the number of feedback stages by varying amounts of the first actuating portion and the electrode terminal. The keyswitch can generate the specific feedback signal while being moved across each feedback stage. The feedback signals respectively generated by the keyswitch moved across all feedback stages of the multistage positioning component can be utilized to purely provide the touch hand feeling; for example, the multistage positioning component may produce several feedback sound or supply powerful feedback force for helping the user to feel the movement depth by auditory sense and tactile sense while the keyswitch is deeply moved. Besides, the feedback signal generated from different feedback stages can be represented as assorted control commands in accordance with the movement depth; for example, the keyswitch can output the minuscule letter by slight press and further output the capital letter by heavy press.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A keyswitch for showing a movement depth, the keyswitch comprising:

a substrate;

a lifting unit disposed on the substrate;

a multistage positioning component disposed on the substrate, the multistage positioning component having a plurality of first actuating portions; and a keycap connected with the lifting unit and disposed adjacent to the multistage positioning component, the keycap having a second actuating portion, the keycap being moved relative to the substrate via the lifting unit and the second actuating portion contacting against one of the plurality of first actuating portions to generate a feedback signal.

2. The keyswitch of claim 1, wherein at least one of the plurality of first actuating portions and the second actuating portion is made of resilient material.

3. The keyswitch of claim 1, wherein a supporting component is disposed on the substrate, and the keycap is partly disposed inside the supporting component in a movable manner.

4. The keyswitch of claim 1, wherein the multistage positioning component is an elastic piece, the plurality of first actuating portions respectively are curved structures, the curved structures are arranged on a body of the multistage positioning component at a moving direction of the keycap.

5. The keyswitch of claim 4, wherein a fixing end of the multistage positioning component is connected to the substrate, and a free end of the multistage positioning component points toward the keycap.

6. The keyswitch of claim 4, wherein two opposite ends of the multistage positioning component are respectively disposed on an inner wall of a supporting component, and the supporting component is located between the substrate and the keycap.

7. The keyswitch of claim 1, further comprising:

a processing unit disposed on the substrate, the processing unit analyzing a moving distance of the keycap relative to the substrate or analyzing a contact relation between the second actuating portion and one of the plurality of first actuating portions to acquire input information while the keyswitch is pressed.

8. The keyswitch of claim 7, further comprising:

an optical detecting unit disposed on the substrate and electrically connected to the processing unit, the optical detecting unit being adapted to detect a movement of the keycap relative to the substrate.

9. The keyswitch of claim 7, wherein the multistage positioning component is an electrode module, the plurality of first actuating portions respectively are electrode terminals, the electrode terminals are arranged on an inner wall of a supporting component at a moving direction of the keycap, and the supporting component is located between the substrate and the keycap.

10. The keyswitch of claim 9, wherein the second actuating portion is made of conductive material, the processing unit is electrically connected to the electrode terminals, the processing unit analyzes the feedback signal generated by contact between the second actuating portion and one of the electrode terminals to acquire the input information while the keyswitch is pressed.

11. A keyboard for showing a movement depth, the keyboard comprising:

a substrate; and a plurality of keyswitches disposed on the substrate, each keyswitch comprising:

a lifting unit disposed on the substrate;

a multistage positioning component disposed on the substrate, the multistage positioning component having a plurality of first actuating portions; and a keycap connected with the lifting unit and disposed adjacent to the multistage positioning component, the keycap having a second actuating portion, the keycap being moved relative to the substrate via the lifting unit and the second actuating portion contacting against one of the plurality of first actuating portions to generate a feedback signal.

12. The keyboard of claim 11, wherein at least one of the plurality of first actuating portions and the second actuating portion is made of resilient material.

13. The keyboard of claim 11, wherein a supporting component is disposed on the substrate, and the keycap is partly disposed inside the supporting component in a movable manner.

14. The keyboard of claim 11, wherein the multistage positioning component is an elastic piece, the plurality of first actuating portions respectively are curved structures, the curved structures are arranged on a body of the multistage positioning component at a moving direction of the keycap.

15. The keyboard of claim 14, wherein a fixing end of the multistage positioning component is connected to the substrate, and a free end of the multistage positioning component points toward the keycap.

16. The keyboard of claim 14, wherein two opposite ends of the multistage positioning component are respectively disposed on an inner wall of a supporting component, and the supporting component is located between the substrate and the keycap.

17. The keyboard of claim 11, further comprising:

a processing unit disposed on the substrate, the processing unit analyzing moving distances of keycaps of the plurality of keyswitches relative to the substrate or analyzing a contact relation between second actuating portions of the keycaps of the plurality of keyswitches and corresponding first actuating portions of the plurality of first actuating portions to acquire input information while the plurality of keyswitches is pressed.

18. The keyboard of claim 17, wherein the each keyswitch comprises an optical detecting unit disposed on the substrate and electrically connected to the processing unit, the optical detecting unit is adapted to detect a movement of the keycap relative to the substrate.

19. The keyboard of claim 17, wherein the multistage positioning component is an electrode module, the plurality of first actuating portions respectively are electrode terminals, the electrode terminals are arranged on an inner wall of a supporting component at a moving direction of the keycap, and the supporting component is located between the substrate and the keycap.

20. The keyboard of claim 19, wherein the second actuating portion is made of conductive material, the processing unit is electrically connected to the electrode terminals, the processing unit analyzes the feedback signal generated by contact between the second actuating portion and one of the electrode terminals to acquire the input information while the keyswitch is pressed.

* * * * *